US007208053B2

(12) United States Patent
Wietzoreck et al.

(10) Patent No.: US 7,208,053 B2
(45) Date of Patent: Apr. 24, 2007

(54) METHOD FOR APPLYING A PHOSPHATE COVERING AND USE OF METAL PARTS THUS PHOSPATED

(75) Inventors: Hardy Wietzoreck, Frankfurt am Main (DE); Klaus Bittner, Frankfurt am Main (DE); Thomas Kolberg, Heppenheim (DE); Marion Wegner, Frankfurt am Main (DE); Thomas Wendel, Schwalbach (DE); Gerrit Schüllermann, Maintal (DE)

(73) Assignee: Chemetall GmbH, Franfurt am Main (DE)

( * ) Notice: Subject to any disclaimer, the term of this patent is extended or adjusted under 35 U.S.C. 154(b) by 418 days.

(21) Appl. No.: 09/980,910

(22) PCT Filed: Mar. 6, 2001

(86) PCT No.: PCT/EP01/02498

§ 371 (c)(1),
(2), (4) Date: Feb. 26, 2002

(87) PCT Pub. No.: WO01/66826

PCT Pub. Date: Sep. 13, 2001

(65) Prior Publication Data

US 2004/0231755 A1 Nov. 25, 2004

(30) Foreign Application Priority Data

Mar. 7, 2000 (DE) ..... 100 10 355

(51) Int. Cl.

| | |
|---|---|
| ***C23C 22/18*** | (2006.01) |
| ***C23C 22/07*** | (2006.01) |
| ***C23C 22/12*** | (2006.01) |
| *C23C 22/05* | (2006.01) |

(52) U.S. Cl. ..... 148/253; 148/240; 148/243; 148/255; 148/256; 148/257; 148/259; 148/260; 106/14.05; 106/14.11; 106/14.12; 106/14.15; 106/14.16; 106/14.41; 106/14.42

(58) Field of Classification Search ..... 148/261–262, 148/251, 240, 243, 255–257, 259–260; 106/14.12, 106/14.05, 14.11, 14.15, 14.16, 14.41, 14.42
See application file for complete search history.

(56) References Cited

U.S. PATENT DOCUMENTS

| | | | | |
|---|---|---|---|---|
| 3,939,014 | A * | 2/1976 | Reed | 148/262 |
| 4,950,339 | A * | 8/1990 | Gehmecker et al. | 148/262 |
| 5,221,370 | A * | 6/1993 | Jo et al. | 148/250 |
| 5,232,532 | A * | 8/1993 | Hori | 156/163 |
| 5,653,790 | A * | 8/1997 | Fotinos et al. | 106/14.12 |
| 5,780,122 | A * | 7/1998 | Shirahata et al. | 427/601 |
| 5,976,272 | A * | 11/1999 | Seidel et al. | 148/261 |
| 6,206,981 | B1 * | 3/2001 | Jenkins | 148/264 |
| 6,743,302 | B2 * | 6/2004 | Cuyler et al. | 148/251 |

FOREIGN PATENT DOCUMENTS

| | | | |
|---|---|---|---|
| DE | 44 33 946 | | 3/1996 |
| DE | 44 43 882 | | 6/1996 |
| DE | 197 49 508 | | 5/1999 |
| EP | 0228 151 | | 7/1987 |
| EP | 774 016 | | 5/1997 |
| EP | 0 796 356 | | 9/1997 |
| GB | 2078788 | * | 1/1982 |

* cited by examiner

*Primary Examiner*—Roy King
*Assistant Examiner*—Lois Zheng
(74) *Attorney, Agent, or Firm*—Fulbright & Jaworski L.L.P.

(57) ABSTRACT

Metallic surfaces are coated with an aqueous, acidic phosphate solution containing 10 to 60 g/l zinc, 0.5 to 40 g/l manganese, 50 to 300 g/l phosphate ions calculated as $P_2O_5$, and optionally other components.

35 Claims, No Drawings

METHOD FOR APPLYING A PHOSPHATE COVERING AND USE OF METAL PARTS THUS PHOSPATED

The invention relates to method for applying phosphate coatings to metallic surfaces by means of wetting with an aqueous phosphating solution and subsequent drying of the phosphating solution, as well as to the use of the metal parts coated in accordance with the invention.

Phosphate coatings are used on a large scale as anticorrosive layers, as deforming aids and also as a primer for lacquer paints and other coatings. Above all when they are used as protection for a limited time, in particular for storage, and then lacquer painted, for example, they are described as a pretreatment layer before lacquer painting. If, however, neither a layer of lacquer nor any other type of organic coating is placed on the phosphate coating, treatment is spoken of instead of pretreatment. These coatings are also described as conversion layers if at least one cation of the metallic surface, i.e. the surface of the metal part, is dissolved out and also used for the layer construction.

Among the coating methods, the so-called drying methods ("no-rinse processes") are highly significant, in particular for the very fast coating of continuously moving strips of at least one metallic material. These strips can be sheets of small or very large width. By wetting with a phosphating solution and drying, a phosphate coating is applied to these strips, usually directly after the galvanisation, possibly, however, also after suitable cleaning or degreasing and after rinsing with water or an aqueous medium and also possibly after an activation of the metallic surface.

Rinsing after the phosphate coating has dried could impair this, particularly if the phosphate coating is not crystalline or is only partly crystalline.

EP-A-0 796 356 describes a method for applying phosphate coatings to surfaces of zinc, iron, aluminium or alloys thereof by wetting with a solution containing nickel, manganese and phosphate, which solution can preferably also contain up to 4 g/l of zinc ions, and drying this solution.

EP-A-0 774 016 teaches a method for phosphating surfaces of steel, zinc, aluminium or alloys of each of these by means of treatment with acidic solutions containing zinc and phosphate and drying the solutions without intermediate rinsing, in which method the phosphating solution which is used has a content of zinc ions of 2 to 25 g/l. $H_2O_2$ with a content of only 20 to 100 ppm is recommended, among others, as a catalyst.

A disadvantage of these methods described in these two publications is that the phosphate layers generated in this way are predominantly amorphous and usually still contain free phosphoric acid, and that, therefore, in the subsequent wetting with an aqueous liquid, which can occur, for example, as a result of spraying or condensation, an unintentional reaction with the free phosphoric acid can occur and lead to local damage, such as, for example, discolourations, recrystallisations and other alterations of the predominantly amorphous phosphate layer, which can be a problem both visually and also with respect to a subsequent process step. Damage of this type, such as a dark streak formation, for example, can still be visible even after the application of a lacquer paint.

The object of the invention is to overcome this disadvantage of the prior art and, in particular, to propose a method for applying phosphate coatings to metallic surfaces, in which method the subsequent contacting with an aqueous liquid or with moisture does not cause any damage, and in which the phosphate layer which is formed has at least the same quality as that according to the prior art.

The object is achieved with a method for applying phosphate coatings to metallic surfaces by wetting with an aqueous, acidic phosphating solution and subsequent drying of the phosphating solution, usually without subsequent rinsing, which method is characterised in that the phosphating solution contains 26 to 60 g/l of zinc ions, 0.5 to 40 g/l of manganese ions, and 50 to 300 g/l of phosphate ions, calculated as $P_2O_5$.

A high content of zinc ions promotes, in particular, the avoidance of free phosphoric acid in the phosphate layer which is generated and also promotes the crystallinity of the phosphate layer. The content of zinc ions preferably amounts to 28 to 50 g/l of zinc ions, particularly preferably 30 to 48 g/l, very particularly preferably 32 to 46 g/l.

In the following, in addition to such parts as metal strip sections and deformed and/or lacquer painted portions, for example, the term metal parts also includes metal strips. This can mean, in this connection, for example, first of all a metal strip and, in the subsequent section of the process, after the cutting up of the strip, metal parts in the actual sense, first of all strip sections and then portions.

In principle, a metal strip can first be pre-treated and lacquer painted and then cut, or first provided with a first pretreatment coating, then cut, then provided with a second pretreatment layer and then lacquer painted. In addition, there is a series of further variants, which are less frequently used, however.

A comparatively high content of manganese ions has a positive effect on the quality of the phosphate coating, above all on the adhesion of lacquer paint and on the corrosion resistance of the subsequently lacquer painted metal parts. The content of manganese ions preferably amounts to 2.5 to 30 g/l, particularly preferably 5 to 25 g/l and very particularly preferably 10 to 25 g/l.

The content of phosphate ions, calculated as $P_2O_5$, preferably amounts to 58 to 280 g/l, very particularly preferably 60 to 260 g/l, in particular 72 to 240 g/l.

The object is furthermore achieved with a method for applying phosphate coatings to metallic surfaces by wetting with an aqueous, acidic phosphating solution and subsequent drying of the phosphating solution, usually without rinsing, in which the phosphating solution contains 10 to 60 g/l of zinc ions, or 0 to 60 g/l of zinc ions in the case of zinc-rich surfaces before wetting, 0.5 to 40 g/l of manganese ions, 50 to 300 g/l of phosphate ions, calculated as $P_2O_5$, and 0.5 to 120 g/l of peroxide ions, calculated as $H_2O_2$, and/or 0.5 to 50 g/l of polymers, copolymers and/or cross polymers.

The zinc ion content preferably amounts to 18 to 56 g/l, particularly preferably 24 to 52 g/l, very particularly preferably 28 to 46 g/l.

The manganese ion content preferably amounts to 12 to 30 g/l, particularly preferably 14 to 28 g/l, very particularly preferably 15 to 26 g/l. The Zn:Mn weight ratio can vary within broad limits.

The content of phosphate ions, calculated as $P_2O_5$, preferably amounts to 57 to 278 g/l, very particularly preferably 58 to 258 g/l, in particular 70 to 238 g/l.

The content of peroxide ions preferably amounts to 1 to 110 g/l, particularly preferably 2 to 100 g/l, very particularly preferably 5 to 85 g/l, in particular 10 to 75 g/l. In this connection, 0.5 g/l $H_2O^2$ corresponds to approximately 380 ppm.

The polymers, copolymers and/or cross polymers are preferably those of N-containing heterocyclic compounds, particularly preferably vinyl pyrrolidones. The content of these polymers, copolymers and/or cross polymers in the phosphating solution preferably amounts to 1 to 45 g/l, particularly preferably 1.5 to 42 g/l, very particularly preferably 2 to 40 g/l and even more preferably 2.5 to 36 g/l. In this connection, 8.5 g/l in the phosphating solution produces a proportion in the phosphate layer of approximately 51 $mg/m^2$.

Polymers, copolymers and/or cross polymers of this type can be particularly helpful in phosphate layers which are used as pre-phosphatings for deforming, in order to greatly reduce the so-called "powdering", namely the rubbing off of the phosphate layer during the deforming.

On the other hand, an addition of a polymeric alcohol can also be advantageous in order to form phosphoric acid esters with this alcohol, in particular upon drying, which have a beneficial effect as lubricants during deforming. At the same time, the addition of a polymeric alcohol can have an effect on the reaction with thee excess free phosphoric acid that is possibly present in the phosphating solution, in order to improve the crystallinity and the water-resistance of the phosphate coating.

The phosphating solution coating can be free or substantially free of nickel or up to 20 g/l of nickel ions can be contained in the phosphating solution. In this connection, the nickel content is directed according to the ultimate aim of the method in accordance with the invention that is used. In a particularly preferred development, no nickel is added to the phosphating solution; if there should then nevertheless be a content of nickel ions in the phosphating solution, this content is usually caused by dissolving out nickel from the metallic surface of the metal parts to be phosphated and also, for example, from pipelines and bath containers, which consist of a nickel-containing material, or trace impurities of the raw materials for preparing the phosphating solutions. The advantage of substantially nickel-free phosphating solution lies in the substantial or complete absence of an element which is physiologically and environmentally hazardous.

Alternatively, however, there can also be a content of nickel ions in the phosphating solution, which can have an advantageous effect on the formation and quality of the phosphate coatings which are generated. In this case, the content of nickel ions preferably amounts to 0.01 to 18 g/l in the phosphating solution, particularly preferably 0.03 to 15 g/l, very particularly preferably 0.05 to 12 g/l, even more preferably 0.1 to 10 g/l, in low-zinc methods in particular 0.2 to 4 g/l or preferably 0.25 to 3 g/l.

The amount of the phosphating solution which is applied to the metal parts for dying can lie in the range from 1 to 12 $ml/m^2$, preferably in the range from 1.5 to 10 $ml/m^2$, very particularly preferably in the range from 2 to 8 $ml/m^2$.

A layer having a layer weight—established on the precipitated and dried phosphate layer—in the range from 0.2 to 5 $g/m^2$, preferably in the range from 0.3 to 4 $g/m^2$, very particularly preferably in the range from 0.4 to 3 $g/m^2$, even more preferably in the range from 0.5 to 2.5 $g/m^2$, in particular 0.6 to 2 $g/m^2$, can be formed with the phosphating solution.

The phosphating solution can be applied to the metal part by spraying, by roller application, by flooding and subsequent squeezing off, by splashing and subsequent squeezing off or by dipping and subsequent squeezing off. The application technique is known. In principle, any way of applying the phosphating solution is possible; however, the above-mentioned variants of the application are preferred. The squeezing off serves to apply a defined liquid volume in relation to the surface of the metal part and can also be replaced by alternative methods; roller application with a "Chemcoater" or a "roll-coater", for example, is particularly preferred.

The liquid film formed on the metal part with the phosphating solution can be dried on the surface of the metal part in the range from 20 to 120° C., in particular from 40° C., with respect to PMT temperatures, in particular at 50 to 100° C. The drying can, for example, take place by blowing with hot air or by heating with infrared radiation, in which case the regulating can be carried out in particular by the PMT method (PMT=peak metal temperature, established by measuring the temperature of the surface of the metal part).

The phosphate layer formed in this way can have the following composition:

it can be free or substantially free of nickel or have a content of up to 10% by weight Ni, and can additionally contain:

5 to 50% by weight Zn, 1.5 to 14% by weight Mn, and 20 to 70% by weight phosphate, calculated as $P_2O_5$.

In particular, it can contain 0.1 to 3 or 0.2 to 2.5% by weight Ni.

In particular, it can contain 10 to 45% by weight Zn, preferably 12 to 42% by weight Zn, particularly preferably 16 to 38% by weight Zn.

In particular, it can contain 3.5 to 13% by weight Mn, preferably 4 to 12% by weight, particularly preferably 5 to 10% by weight, the layer quality, as a rule, being better with a relatively high manganese content.

It can preferably contain 25 to 60% by weight phosphate, particularly preferably 28 to 50% by weight, very particularly preferably 30 to 40% by weight.

In a particularly advantageous variant of the method, the metal parts to be coated, preferably in the form of metal strips, are first coated in accordance with the invention with a first phosphating solution and subsequently, preferably as individual portions or as portions which are connected to each other by joining, such as by gluing or welding for example, after the drying of the first phosphating solution, they are wetted with a second, aqueous, acidic phosphating solution, with this second solution being free or substantially free of nickel, or containing up to 20 g/l of nickel ions and 0 to 20 g/l of zinc ions, 0 to 5 g/l of manganese ions, 5 to 50 g/l of phosphate ions, calculated as $P_2O_5$.

The composition of the second phosphating solution corresponds in most cases to a phosphating solution which is known in principle, and the method for applying it is also usually known, this second solution not being dried, as a rule. While the first phosphate layer is preferably applied in a belt conveyor system, the second phosphate layer can, for example, be applied in an automobile factory or on the premises of an appliance manufacturer.

Before wetting with the first and/or with the second phosphating solution, the metal parts can be wetted with an activating solution or an activating suspension. The surface is provided with seed crystals as a result of such an activation, which favours the subsequent phosphating and the formation of fine-crystalline, dense phosphate layers. In this connection, an aqueous activating solution/suspension with a content of colloidally distributed titanium phosphate can preferably be chosen.

The first phosphating solution can be applied to the metal part by coating with the phosphating solution, for example with a roll-coater or with a similar roller-application device. The technique of the application is known in principle.

The first and/or second phosphating solution of the method in accordance with the invention can advantageously contain ions of aluminium, boron, iron, hafnium, molybdenum, silicon, titanium, zirconium, fluoride and/or complex fluoride, at least one water-soluble alkaline-earth compound and/or organic complexing agents such as citric acid, for example. Fluoride can be present in free and/or bound form, in particular with a content in the range from 0.01 to 5 g/l, in particular in the range from 0.02 to 3 g/l, particularly preferably in the range from 0.05 to 2 g/l. In particular, the first phosphating solution can contain 0.0003 to 10 g/l, preferably 0.0004 to 5 g/l, particularly preferably 0.0005 to 0.05 g/l of copper ions, the second a content of 0.1 to 50 mg/l of copper ions, in particular from 2 to 20 mg/l. The copper ions speed up the formation of the phosphate layer and promote the quality thereof.

The first and/or second phosphating solution of the method in accordance with the invention is preferably free or substantially free of ions of lead, cadmium, chromium, chloride and/or cyanide, because these substances are not sufficiently environmentally tolerable and/or impair the phosphating process and can also reduce the quality of the phosphate layer.

The first and/or the second phosphating solution can, in particular, be adjusted in such a way that the ratio of the sum of the cations to phosphate ions, calculated as $P_2O_5$, lies in the range from 1:1 to 1:8. Preferably, this ratio lies in the range from 1:1.2 to 1:7, and particularly preferably in the range from 1:1.5 to 1:5. In many cases, it is advantageous to work with a proportion of free phosphoric acid in the phosphating solution in order that a reaction with the metallic surface can take place; as a result of this, metal ions are dissolved out of the metallic surface, which metal ions in turn react with the unbound phosphate ions to form insoluble phosphate.

In the first and/or second phosphating solution, the A-value, the ratio of the free acid to the total content of phosphate ions, can lie in the range from 0.03 to 0.7. This A-value range then corresponds approximately to the pH-value range of 4 to 1. Preferably, the pH-value lies in the range from 3 to 1.5, and very particularly preferably in the range from 2.8 to 1.7. For the second phosphating solution, the A-value preferably amounts to 0.2 to 0.03.

In order to determine the free acid, 1 ml of the phosphating solution is, after dilution to approximately 50 ml with distilled water, possibly with addition of $K_3(Co(CN)_6)$ or $K_4(Fe(CN)_6)$ for the purpose of removing disturbing metal ions, titrated with 0.1 M NaOH, using dimethyl yellow as the indicator, until change from pink to yellow. The amount of 0.1 M NaOH in ml that is used gives the value of the free acid (FS) in points.

The total content of phosphate ions is determined, following the establishing of the free acid, by titrating the titration solution, after addition of 20 ml of 30% neutral potassium oxalate solution, with 0.1 M NaOH against phenolphthalein as indicator until the change from colourless to red. The consumption of 0.1 M NaOH in ml between the change with dimethyl yellow and the change with phenolphthalein corresponds to the total acid according to Fischer (GSF). If this value is multiplied by 0.71, the total content of phosphate ions results (see W. Rauch: "Die Phosphatierung von Metallen", Eugen G. Leuze publishing house 1988, pp 300 ff).

The so-called A-value is obtained by dividing the value of the free acid by the value of the total acid according to Fischer.

The total acid (TA) is the sum of the bivalent cations which are contained as well as free and bonded phosphoric acids (the latter are phosphates). It is determined by the consumption of 0.1 molar sodium hydroxide solution using the indicator phenolphthalein. This consumption in ml corresponds to the number of points of the total acid.

The first and/or the second phosphating solution can contain at least one catalyst. In principle, all catalysts can be used. Preferably, a catalyst such as a peroxide, a substance based on nitroguanidine or based on hydroxylamine, a chlorate, a nitrate, a perborate and/or an organic nitro compound, such as p-nitrotoluene sulphonic acid, is contained in the phosphating solution. Particularly preferable in this connection is a content of $H_2O_2$, because with this, a residue-free acceleration is possible, because only water and oxygen are left over. The first and/or the second phosphating solution can advantageously contain a peroxide admixture, preferably $H_2O_2$, in a concentration in the range from 1 to 100 g/l, preferably from 5 to 90 g/l, in particular from 10 to 80 g/l, calculated as $H_2O_2$. Above all, as a result of the high content of $H_2O_2$, at the usually high velocities in the belt conveyor system, it is possible to achieve an acceleration of all chemical reactions that occur in the wet film and during the drying within a few seconds and to effect a corresponding thorough reaction. This has a very advantageous effect on the layer quality, particularly in the case of this high-zinc method.

Advantageously, at least one compound based on formic acid, succinic acid, maleic acid, malonic acid, lactic acid, perboric acid, tartaric acid, citric acid and/or a chemically related hydroxy carboxylic acid can be added in order to stabilise the bath or the concentrate or the supplementary solution, in particular in order to avoid or reduce precipitations from one of these solutions, and also to increase the crystallinity of the phosphate layer, as a result of which the water-resistance of the phosphate layer is clearly improved. The total addition of such compounds to form a solution of this type can lie in the range from 0.01 to 5 g/l. The content of at least one of these compounds preferably lies in the range from 0.1 to 3 g/l. In this connection, a content of sodium perborate of 0.2 to 3.5 g/l, of tartaric acid in the range from 0.2 to 0.8 g/l, or of citric acid in the range from 0.12 to 0.5 g/l has proven itself particularly well. Even better results were achieved with a combination of 0.2 to 0.8 g/l of sodium perborate and 0.2 to 0.8 g/l of tartaric acid.

The first and/or second phosphating solution can be applied at a temperature in the range from 10 to 80° C. Preferably, in the case of the first phosphating solution, work is carried out at room temperature or at a slightly higher temperature; only in special cases are the metal parts and/or possibly also the phosphating solution heated to a slightly raised temperature, for example in order to speed up the drying of the applied solution.

The first phosphating layer can remain unaltered during wetting with the second phosphating solution, or can be slightly solubilised in the upper region and remain unaltered in its structure, and/or can be removed slightly by the second phosphating solution, while an additional phosphate layer can be precipitated from the second phosphating solution, but does not have to be precipitated. It has emerged, however, that the resistance of the first phosphate layer to fluids such as splashed water or cleaning fluid, in particular the resistance to alkali, is higher the more crystalline the structure of the layer.

The second phosphating solution can be applied to the metal part by spraying, flooding or dipping, among others. The technique of the application is known in principle. Any way of applying the phosphating solution is possible; however, the above-mentioned variants of the application are preferred.

It can be advantageous to apply a passivating solution directly on to the first or second phosphate layer, in particular by spraying, dipping or rolling. In this connection, a rinsing solution is preferably used to further increase the corrosion resistance and the lacquer paint adhesion, which rinsing solution can contain at least one substance based on Cr, Ti, Zr, Ce and/or other rare earth elements including lanthanum or yttrium, tannin, silane/siloxane, phosphorus-containing self-assembling molecules, phosphonates or polymers.

The first and/or second phosphate layer which has dried on to the metal part can be wetted with an oil, a dispersion or a suspension, in particular with a deforming oil or anticorrosive oil and/or a lubricant such as a dry lubricant, for example with a wax-containing mixture. The oil or the lubricant is used as an additional temporary protection against corrosion and can additionally also facilitate a deforming process, in which case the deformed metal part also has an increased corrosion resistance. A coating with an oil can also be of interest on the second phosphate layer if the metal parts to be lacquer painted are to be transported to a lacquer painting installation which is further away. Preferably, oil is not applied until after the pre-phosphating, before the metallic substrate is deformed.

An oil coating or lubricant coating which is possibly present can be removed from or out of the first or second phosphate layer respectively, in order to prepare the coating for the lacquer painting, deforming, assembly, for gluing or for welding. The oil has to be removed for a subsequent lacquer painting, while in the case of other method steps it can be removed.

The metal parts which have been provided with the first and/or second phosphate layer can be coated with a lacquer paint, with another type of organic coating and/or with a layer of adhesive, and possibly deformed before or after a coating of this type, in which case the metal parts which have been coated in this way can also additionally be glued and/or welded to other metal parts before the lacquer painting or organic coating. The deforming, gluing or welding can also take place in the presence of an oil. The oil is often removed with cleaner before the start of the second phosphating. The metal parts which have been provided with a first and/or second phosphate layer can be provided with an organic coating or lacquer paint coating either before or not until after the deforming and/or assembly. Today, the widest variety of organic coatings are known and can be used on a phosphate layer. In this connection, not all organic coatings come under the definition of lacquer paints.

The metal strips which have been phosphate-coated in accordance with the invention can be oiled if necessary in a so-called belt conveyor system and possibly degreased and/or cleaned if necessary before they are subsequently coated in a lacquer painting installation. For economic reasons, the removal of the oil before the gluing or welding is preferably dispensed with.

For the production of appliance casings, for example, the metal parts which have been phosphate-coated in accordance with the invention can be oiled if required, cut and deformed if required or degreased and/or cleaned if required before they are subsequently—if desired—coated in a lacquer painting installation. They can also be cut and deformed in the lacquer painted state, however.

For the manufacture of automobiles, for example, the metal parts which have been phosphate-coated in accordance with the invention can be oiled and deformed, in which case a plurality of metal parts can then he welded together, glued together or connected in another way, and the assembled metal parts can then be degreased and/or cleaned, before they can then be coated in a lacquer painting installation.

The metal parts which have been coated in accordance with the invention, as pre-phosphated metal parts for a renewed conversion treatment or for a renewed conversion pretreatment—in particular before the lacquer painting—or as pretreated metal parts—in particular for the automobile industry—above all before the lacquer painting, or as finally phosphated metal parts, which are possibly also subsequently lacquer painted, can be coated organically in another way, coated with a layer of adhesive, deformed, assembled and/or welded. They can be used for the production of components or body parts or pre-assembled elements in the automobile industry or aircraft industry, in the construction industry, in the furniture industry, for the production of appliances and installations, in particular household appliances, measuring apparatus, control devices, testing devices, structural elements, casings, and also of small components.

The methods in accordance with the invention are outstandingly suitable for very many metallic surfaces, in particular for surfaces of steel, iron, aluminium, magnesium, zinc and alloys of each of these, preferably for galvanised or alloy-galvanised surfaces, and ensure a particularly high level of lacquer paint adhesion and also high-quality protection against corrosion.

With the method in accordance with the invention, it is possible to use a completely nickel-free phosphating process for high phosphate-layer qualities, for example as a pretreatment before lacquer painting.

In this connection, it has emerged that the more crystalline the structure of the phosphate layer which is generated, the more insensitive it is to aqueous fluids, moisture and other damaging, above all corrosive, media. The phosphate layer in accordance with the invention has proven to be outstandingly insensitive because of its crystallinity. The crystallinity has been formed surprisingly excellently above all in the case of relatively high and high zinc contents in combination with a high peroxide content. Even better crystallinity of the phosphate layer and thus an even better resistance to water and resistance of this layer to alkaline cleaners, for example, has emerged when an additional activation is carried out before the phosphating.

In most cases, the phosphating installations in the automobile industry are provided with weakly alkaline cleaners, in some cases, however, even with strongly alkaline cleaners. It has been surprising that the first crystalline pre-phosphating layer in accordance with the invention is clearly more resistant to the influence of strongly alkaline cleaners. The first phosphate layer in accordance with the invention was not impaired or was only slightly impaired with the short processing times that are usually used with a strongly alkaline cleaner.

A mix of different materials, such as, for example, metal parts consisting of an uncoated steel and pre-phosphated metal parts, can be coated simultaneously side by side without problems with the method in accordance with the invention.

A better protection against corrosion than according to the cited prior art can be achieved with pre-assembled or assembled metal parts with pre-phosphating in hollow spaces, even without application of a lacquer paint.

EXAMPLES

The subject-matter of the invention is explained in greater detail in the following with the aid of exemplifying embodiments.

Test Series A:

Metal sheets consisting of electrolytically galvanised steel strip and, parallel hereto, of hot-dip-galvanised steel strip were treated as follows: Sheet dimensions: 105×190×0.7 mm. First of all, spray cleaning took place in an alkaline cleaning bath, followed by three short rinses with water. After the rinsing process, the metal sheets were prepared for the application, in accordance with the invention, of the phosphating solution by being dipped into a titanium-phosphate-containing activating solution with subsequent squeezing off of the liquid film. The phosphating solution was applied by means of a roll-coater. After the application of the phosphating solution, the sheets were dried for 30 seconds at 180° C. in a furnace (PMT=80° C.). The resulting layer weight of the dried-in liquid film was 1.5 g/m$^2$.

The treatment sequence is summarised in the following:

cleaning: with Gardoclean® 338, 8 g/l, 60° C., 10 sec spraying rinsing: with cold water, 10 sec dipping rinsing: with cold water, 4 sec dipping rinsing: with deionised water (=VEW), 5 sec dipping activating: with Gardolene® V6513, 4 g/l in VEW, 5 sec dipping squeezing off: by means of squeeze roller roller application: phosphating solution in accordance with the invention (see Table 1) with a roll coater drying: in furnace at 180° C., 30 seconds, PMT=80° C.

TABLE 1 composition and density of the phosphating solutions in accordance with the invention in g/l and g/cm$^3$ respectively.

| | Example | | | | | | | | | | | |
|---|---|---|---|---|---|---|---|---|---|---|---|---|
| | B1 | B2 | B3 | B4 | B5 | B6 | B7 | B8 | B9 | B10 | B11 | B12 |
| $P_2O_5$ (g/l) | 226 | 223 | 151 | 134 | 228 | 134 | 139 | 205 | 207 | 138 | 196 | 196 |
| Zn (g/l) | 42.0 | 41.4 | 59.0 | 24.8 | 60.0 | 24.9 | 25.7 | 31.1 | 31.4 | 25.6 | 17.0 | 17.0 |
| Mn (g/l) | 25.1 | 24.7 | 16.3 | 14.7 | 25.2 | 14.7 | 15.2 | 36.4 | 36.6 | 15.1 | 11.9 | 12.0 |
| Ni (g/l) | 9.2 | 0 | 6.3 | 0 | 0 | 0 | 0 | 0 | 5.3 | 0 | 0 | 0 |
| polymer (g/l) | 0 | 0 | 0 | 9.0 | 0 | 18.1 | 58.5 | 0 | 0 | 0 | 1.0 | 0 |
| $NO_3$ (g/l) | 0 | 0 | 63.3 | 0 | 0 | 0 | 0 | 0 | 0 | 0 | 0 | 0 |
| $H_2O_2$ (g/l) | 0 | 0 | 0 | 0 | 0 | 0 | 0 | 0 | 0 | 50 | 0 | 35 |
| density (g/cm$^3$) | 1.272 | 1.255 | 1.258 | 1.129 | 1.279 | 1.131 | 1.169 | 1.245 | 1.255 | 1.165 | 1.187 | 1.190 |
| A-value | 0.21 | 0.31 | 0.25 | 0.32 | 0.14 | 0.32 | 0.32 | 0.21 | 0.15 | 0.32 | 0.65 | 0.65 |
| ratio cations:$P_2O_5$ | 1:2.9 | 1:3.4 | 1:1.8 | 1:3.4 | 1:2.7 | 1:3.4 | 1:3.4 | 1:3.0 | 1:2.8 | 1:3.4 | 1:6.78 | 1:6.78 |

| | Example | | | | | | | | | | | |
|---|---|---|---|---|---|---|---|---|---|---|---|---|
| | B13 | B14 | B15 | B16 | B17 | B18 | B19 | B20 | B21 | B22 | B23 | B24 |
| $P_2O_5$ (g/l) | 198 | 198 | 198 | 198 | 198 | 198 | 198 | 198 | 198 | 198 | 230 | 230 |
| Zn (g/l) | 17.0 | 17.0 | 18.0 | 18.0 | 18.0 | 18.0 | 17.0 | 17.0 | 18.0 | 18.0 | 37.0 | 37.0 |
| Mn (g/l) | 12.0 | 12.0 | 22.0 | 22.0 | 22.0 | 22.0 | 12.0 | 12.0 | 22.0 | 22.0 | 40.0 | 40.0 |
| Ni (g/l) | 6.0 | 6.0 | 0 | 0 | 6.0 | 6.0 | 6.0 | 0 | 6.0 | 0 | 0 | 7.7 |
| polymer (g/l) | 1.0 | 0 | 1.0 | 0 | 1.0 | 0 | 1.0 | 1.0 | 1.0 | 1.0 | 0 | 0 |
| $NO_3$ (g/l) | 0 | 0 | 0 | 0 | 0 | 0 | 0 | 0 | 0 | 0 | 0 | 0 |
| $H_2O_2$ (g/l) | 0 | 35 | 0 | 35 | 0 | 35 | 35 | 35 | 35 | 35 | 60 | 80 |
| density (g/cm$^3$) | 1.198 | 1.195 | 1.202 | 1.200 | 1.213 | 1.210 | 1.198 | 1.190 | 1.211 | 1.202 | 1.260 | 1.280 |
| A-value | 0.57 | 0.57 | 0.52 | 0.52 | 0.45 | 0.45 | 0.57 | 0.65 | 0.45 | 0.52 | 0.18 | 0.12 |
| ratio cations:$P_2O_5$ | 1:5.66 | 1:5.66 | 1:4.95 | 1:4.95 | 1:4.30 | 1:4.30 | 1:5.70 | 1:6.80 | 1:4.30 | 1:4.95 | 1:2.99 | 1:2.72 |

| | Example | | | | | | | | | |
|---|---|---|---|---|---|---|---|---|---|---|
| | B25 | B26 | B27 | B28 | B29 | B30 | B31 | B32 | B33 | B34 |
| $P_2O_5$ (g/l) | 230 | 283 | 230 | 300 | 300 | 120 | 120 | 214 | 214 | 196.3 |
| Zn (g/l) | 37.0 | 56.7 | 37.0 | 40.0 | 40.0 | 12 | 12 | 40.0 | 40.0 | 37.1 |
| Mn (g/l) | 40.0 | 40.0 | 40.0 | 40.0 | 40.0 | 8 | 8 | 23.6 | 23.6 | 21.8 |
| Ni (g/l) | 0 | 8.1 | 0 | 0 | 0 | 0 | 0 | 0 | 0 | 7.9 |
| polymer (g/l) | 0 | 0 | 8.0 | 0 | 13.3 | 0 | 3.0 | 0 | 13.3 | 0 |
| $NO_2$ (g/l) | 0 | 0 | 0 | 0 | 0 | 0 | 0 | 0 | 0 | 0 |
| $H_2O_2$ (g/l) | 80 | 80 | 60 | 60 | 60 | 25 | 25 | 50 | 50 | 43.5 |
| density (g/cm$^3$) | 1.260 | 1.310 | 1.265 | 1.288 | 1.287 | 1.120 | 1.121 | 1.240 | 1.242 | 1.250 |
| A-value | 0.18 | 0.13 | 0.18 | 0.28 | 0.28 | 0.61 | 0.61 | 0.31 | 0.31 | 0.20 |
| ratio cations:$P_2O_5$ | 1:2.99 | 1:2.70 | 1:2.99 | 1:3.75 | 1:3.75 | 1:6.00 | 1:6.00 | 1:3.36 | 1:3.36 | 1:2.94 |

TABLE 1-continued composition and density of the phosphating solutions in accordance with the invention in g/l and g/cm$^3$ respectively.

| | Example | | | | | | | | | |
|---|---|---|---|---|---|---|---|---|---|---|
| | CE1 | CE2 | CE3 | CE4 | CE5 | CE6 | CE7 | CE8 | CE9 | CE10 |
| $P_2O_5$ (g/l) | 198 | 198 | 402 | 402 | 420 | 465 | 492 | 420 | 477 | 477 |
| Zn (g/l) | 18.0 | 18.0 | 78.5 | 78.5 | 68.0 | 97.0 | 95.0 | 68.0 | 61.0 | 61.0 |
| Mn (g/l) | 12.0 | 22.0 | 55.3 | 55.3 | 78.0 | 80.0 | 80.0 | 78.0 | 80.0 | 80.0 |
| Ni (g/l) | 6.0 | 6.0 | 7.3 | 7.3 | 9.7 | 0 | 10.3 | 0 | 0 | 0 |
| polymer (g/l) | 0 | 0 | 2.0 | 0 | 0 | 0 | 0 | 0 | 0 | 13.3 |
| $NO_3$ (g/l) | 0 | 0 | 0 | 0 | 0 | 0 | 0 | 0 | 0 | 0 |
| $H_2O_2$ (g/l) | 0 | 0 | 60 | 0 | 80 | 80 | 80 | 60 | 60 | 60 |
| density (g/cm$^3$) | 1.198 | 1.213 | 1.454 | 1.454 | 1.501 | 1.540 | 1.587 | 1.501 | 1.540 | 1.540 |
| A-value | 0.57 | 0.45 | 0.12 | 0.12 | 0.11 | 0.12 | 0.10 | 0.11 | 0.20 | 0.20 |
| ratio cations:$P_2O_5$ | 1:5.50 | 1:4.30 | 1:2.85 | 1:2.85 | 1:2.70 | 1:2.63 | 1:2.66 | 1:2.88 | 1:3.38 | 1:3.09 |

TABLE 2 layer composition in mg/m$^2$ on electrolytically galvanised steel strip (EG)

| | Example | | | | | | |
|---|---|---|---|---|---|---|---|
| | B1 | B2 | B3 | B4 | B5 | B6 | B7 |
| Mn | 75.2 | 74.2 | 48.9 | 44.0 | 75.6 | 44.1 | 45.6 |
| Ni | 27.6 | 0.0 | 18.8 | 0.0 | 0.0 | 0.0 | 0.0 |
| Polymer | 0.0 | 0.0 | 0.0 | 27.1 | 0.0 | 54.3 | 175.4 |
| $P_2O_5$ | 679.2 | 670.2 | 451.8 | 402.4 | 683.0 | 403.1 | 416.6 |
| $NO_3$ | 0.0 | 0.0 | 189.8 | 0.0 | 0.0 | 0.0 | 0.0 |

The layer weight of the pre-phosphating layer amounted to 1.2 to 1.8 g/m$^2$; the zinc content varied with the acid value and lay in the range from 62 to 820 mg/m$^2$.

Surprisingly, with increasing cation content in the ratio of cations:$P_2O_5$, a clear tendency to form an improved crystallinity of the phosphate layers resulted. With an improved crystallinity, these layers are also more resistant to water, liquid cleaning compositions and other fluids, so that, for example, splashes of water which get on to the temporarily stored, pre-phosphated strips or strip sections do not lead to specks and other markings which, in extreme cases, can remain visible through the subsequently applied subsequent phosphating layer and/or following lacquer paint layers.

In a test series, immediately after this, the pre-phosphated test sheets were lacquer painted either only with a cathodic automobile dipping lacquer paint or with an automobile lacquer paint total structure, and produced, results in the usual automobile lacquer paint tests, such as, for example, cross-cut adhesion test after wet storage, VDA alternating climate test etc, even in the case of nickel-free coatings, which were equally as good as those in the case of the test sheets which were phosphated twice in accordance with the invention and subsequently lacquer painted.

Apart from this, it was surprising that these test sheets which were coated in accordance with the invention—even when they were applied in a nickel-free manner—delivered equally good results in comparison with a conventional tri-cation-automobile-phosphating with an NiMn-modified low-zinc phosphating, because, with the latter phosphating, excellent results were hitherto achieved only with a certain nickel content.

The pre-phosphated sheets of electrolytically galvanised (EG) or hot-dip galvanised steel (HDG) and hot-dip alloy-galvanised steel with a coating based on ZnFe (Galvaneal) were subjected to different deforming tests. For this purpose, approximately 0.5 g/m$^2$ of a deforming oil typically used in the automobile industry was applied to all pre-phosphated test sheets and to the sheets which were not pre-phosphated (CE 28).

TABLE 3

Results of the deforming tests on pre-phosphated test sheets made of steel coated in different ways.

| | | Flat die multi-rubbing test (coefficient of friction) | Maximum blank holder force test (kN) | Weight loss cup test (g/m$^2$) |
|---|---|---|---|---|
| B28 | EG | 0.135/0.096 | 83 | — |
| | HDG | 0.117/0.098 | 135 | — |
| | ZnFe | 0.142/0.116 | >115 | 1.1 |
| B29 | EG | 0.132/0.126 | 95 | — |
| | HDG | 0.113/0.113 | >140 | — |
| | ZnFe | 0.130/0.115 | >135 | 0.3 |
| B32 | EG | 0.128/0.087 | 136 | — |
| | HDG | 0.118/0.083 | 117 | — |
| | ZnFe | 0.127/0.115 | 48 | 0.2 |
| B34 | EG | 0.122/0.094 | 90 | — |
| | HDG | 0.098/0.095 | 135 | — |
| | ZnFe | 0.139/0.113 | 55 | 5.9 |

In the flat die multi-rubbing test, the coefficient of friction is determined and given after 1 and 10 operations. The lower the coefficient of friction in each case, the better the results. In this way, the slide-facilitating properties of the pre-phosphating layer are reproduced.

In the maximum blank holder force test, the force in kN required in order to achieve only the necessary flowing of the material of the sheet, in the case of gripping from both sides, laterally around a die acting from above, which die generates a cup-shaped indentation, without the sheet tearing in this connection, is established. The higher the forces applied in this connection without tears occurring, the better the results.

In the weight loss cup test, the weight loss during deforming is determined, with it being possible for both the pre-phosphating layer and the Galvaneal coating to be removed. A hold-down force of 10 kN, a diameter of impression of 50 mm and a die diameter of 90 mm were used, the die not being pressed through the pre-phosphated sheet and no tears being created. The weight of the test portions before and after the deforming was determined and the weight loss was indicated in g/m$^2$, which weight loss should be as low as possible.

The aim of these tests was for the deforming capacity of the pre-phosphatings in accordance with the invention to lie at least in the same order of magnitude as the comparable nickel-containing pre-phosphatings. The values of the nickel-free samples with a Galvaneal layer are clearly better than those of the nickel-containing samples with a Galvaneal layer and clearly better than those of the samples which were not pre-phosphated.

Test Series B, C and D:

Test series B and C were carried out on electrolytically galvanised steel strips or steel sheets, and test series D was carried out on . . . aluminium . . . . The following compositions of the phosphating baths were used for pre-phosphating and subsequent phosphating.

TABLE 4

Compositions of the phosphating solutions 1 to 5 with content data in g/l:

| | phosphating solution/g/l | | | | |
|---|---|---|---|---|---|
| | 1 pre-phosphating | 2 pre-phosphating | 3 pre-phosphating | 4 subsequent phosphating | 5 subsequent phosphating |
| Zn | 37.1 | 39.0 | 1.37 | 1.40 | 0.80 |
| Mn | 21.8 | 39.0 | 1.93 | 0.90 | 0.80 |
| Ni | 7.93 | — | 1.26 | 0.90 | 0.80 |
| $P_2O_5$ | 196.3 | 300 | 13.5 | 14.0* | 12.0 |
| $H_2O_2$ | 43.5* | 30.0 | — | — | — |
| $NO_3$ | — | — | 7.00 | 5.00 | 3.00 |
| $NO_2$ | — | — | 0.1 | 0.1 | 0.1 |
| $SiF_6$ | — | — | — | 1.30 | 1.00 |
| F free | — | — | — | 0.18* | 0.03 |
| free acid | 2.6 | 6.1 | 2.9 | 2.1* | 1.9 |
| total acid | 20.0 | 26.3 | 29.3 | 28.5* | 27.1 |
| total acid according to Fischer | 13.2 | 19.0 | 19.0 | 19.7* | 16.9 |
| A-value | 0.20 | 0.32 | 0.15 | 0.11 | 0.11 |

*insofar as another value not indicated in the individual experiment

In test series B (B 35 or CE 35), a portion of the electrolytically galvanised steel strip, in each case after treatment with a titanium-containing activating solution in a separate bath, was pre-phosphated with the pre-phosphating solution 1 on a roll-coater in the no-rinse method. In this connection, a layer weight of the pre-phosphating layer of more or less exactly 1.5 g/m$^2$ was achieved. The pre-phosphating layer had an excellent crystallinity and resistance to water and other liquids, so that no speckling, for example because of splashed water, which wets the phosphating layer, absorbs dissolved constituents and then dries, can occur.

After this, the pre-phosphated strips (B 35) or the strips which had not been pre-phosphated (CE 35) were cut up and the sheets which were obtained were treated with a titanium-containing activating solution and then phosphated for a second time with the phosphating solution 4. The sheets which were not pre-phosphated had a layer weight of the subsequent phosphating layer of approximately 3.0 g/m$^2$, while the pre-phosphated sheets had a layer weight of only approximately 2.3 g/m$^2$. The pre-phosphating layer surprisingly led only to the formation of a subsequent phosphating layer which is comparatively thin but of substantially equally high quality because of the good crystallinity and resistance, in which case the layer thickness of the second phosphating layer was sufficient and in this connection it was even possible to make a saving on chemicals.

Subsequently, in an automobile production line, first of all a KTL lacquer paint coating of a BASF lacquer paint and then a filler and covering lacquer paint coating with a lacquer paint system corresponding to VW Mosel was applied. The tests carried out on these lacquer painted sheets produced the following results.

TABLE 5

Results of the anticorrosive and lacquer paint adhesion tests in test series B (*condensed moisture - constant climate test over 240 hours according to DIN 50017 KK):

| | corrosion: 12 months' free weathering VDA | lacquer paint adhesion: chipping according to VW specification: 12 rounds salt-spray - condensation water alternating test according to VDA 621–415 | | | lacquer paint adhesion: cross-cut according to DIN EN ISO | |
|---|---|---|---|---|---|---|
| | 621–414 infiltration | infiltration | lacquer paint chippings | | 2409 grade of the chippings | |
| | mm | mm | grade | % area | start | KK test* |
| B 35 | U < 1 | U 1.8 | 1.0 | 0.5 | Gt 1 | Gt 2 |
| CE 35 | U < 1 | U 1.5 | 1.0 | 0.5 | Gt 1 | Gt 2 |

In this connection, values of the infiltration up to U 2.5 mm, of the lacquer paint chippings up to 10% and the cross-cut grading up to Gt 2 can be regarded as sufficiently good.

The sheets which were pre-phosphated and phosphated for a second time in accordance with the invention achieved substantially the same high quality as the sheets which were not pre-phosphated and only subsequently phosphated. Apart from this, two assembly groups were produced, one or which had only pre-phosphate and lacquer paint layers and the other had only subsequently phosphated and lacquer paint layers; the assembly group which was only pre-phosphated and lacquer painted produced corrosion results and lacquer paint adhesion results of at least equal value to the assembly group which was only subsequently phosphated and lacquer painted. In this way, it was possible to show that the sheets which were pre-phosphated in accordance with the invention and possibly then additionally phosphated for a second time and lacquer painted take full account of the conditions of the automobile industry. It is therefore also possible to subsequently phosphate and to lacquer paint composites of portions in which some but not all of the portions in the composite have been pre-phosphated.

In test series C, all test strips (B36-B43, CE 36) apart from one test strip (CE 37) were pre-phosphated in accordance with the invention on a roll-coater in the no-rinse method. CE 37 on the other hand was pre-phosphated in the conventional spraying method. With the low cation contents as selected in CE 37, it was not to be possible in the case of a roller application and the short wetting times of the no-rinse method to generate sufficiently thick coatings. In the case of B 40 and CE 37, the test strips were treated before the pre-phosphating with a titanium-containing activating solution. In the case of B 36 to B 41, the phosphating solution 1 was used for the pre-phosphating, and in the case of B 42 and B 43, the phosphating solution 2 was used, without peroxide content or with different levels of peroxide content. All of the sheets were then re-activated with the titanium-based activation which had already been used in some cases, and treated with the subsequent phosphating solution 5, in order to form a second phosphating layer.

Quality of the pre-phosphating layer: A
amorphous, not water-resistant B
partially crystalline, fully water-resistant C very crystalline and water-resistant, resistant to liquids In this connection, it emerged that the crystallinity of the pre-phosphating layer in the case of a high zinc content depends substantially on a sufficient content of peroxide in the phosphating solution. In this test series, it emerged that the layer weight in the pre-phosphating layer rose more strongly if a treatment with an activating solution was carried out beforehand, and that a slightly lower layer weight of the subsequent phosphating layer than otherwise was then formed.

The sheets coated in this way were coated in an automobile production line with a lead-containing KTL lacquer paint coating PPG 742-962/G5, but not with further lacquer paint layers. Corrosion resistance and lacquer paint adhesion were determined on these sheets.

TABLE 7

| | results of the corrosion tests and lacquer paint adhesion tests of test series C: | | |
|---|---|---|---|
| | lacquer paint adhesion; cross-cut according to BMW before and after 40 hours in 5% NaCl solution at 40° C. cross-cut grade according to DIN EN ISO 2409 | | corrosion: 10 weeks; Ford scab test according to BI 123-01 infiltration in mm |
| | at start | after 40 hours | measured on one side |
| CE 36 | Gt 0 | Gt 1 | U 1.5 |
| B 36 | Gt 0 | Gt 1 | U 1.0–1.5 |
| B 37 | Gt 0 | Gt 1 | U 1.5 |
| B 38 | Gt 1 | Gt 1 | U 1.5 |
| B 39 | Gt 1 | Gt 1 | U 1.0–1.5 |
| B 40 | Gt 1 | Gt 1 | U 1.0–1.5 |
| B 41 | Gt 0 | Gt 0–1 | U 1.0–1.5 |
| B 42 | Gt 0 | Gt 1 | U 1.5 |
| B 43 | Gt 0 | Gt 1 | U 1.5–1.8 |
| CE 37 | Gt 0 | Gt 1 | U 1.5 |

TABLE 6

| | Conditions and results of the pre-phosphating or subsequent phosphating in test series C. | | | | | | |
|---|---|---|---|---|---|---|---|
| | additional | pre-phosph. solution | $H_2O_2$ in bath | pre-phosphating layer | average grain size in μm | layer weight in g/m² in each case only of one phosphate layer | |
| | activation | see Tab. 4 | g/l | quality | pre-ph. | pre-ph. | subs. ph. |
| CE 36 | — | — | — | — | — | — | 3.7 |
| B 36 | — | 1 | 0 | A | — | 1.7 | 3.2 |
| B 37 | — | 1 | 0 | A | — | 1.4 | 3.3 |
| B 38 | — | 1 | 30 | B | — | 1.1 | 3.7 |
| B 39 | — | 1 | 50 | C | 5–10 | 0.9 | 3.5 |
| B 40 | Ti | 1 | 50 | C | approx 5 | 1.4 | 3.3 |
| B 41 | — | 1 | 80 | C | 5–10 | 0.9 | 4.2 |
| B 42 | — | 2 | 0 | A | 5–10 | 2.1 | 3.3 |
| B 43 | — | 2 | 50 | C | 5–10 | 0.9 | 4.3 |
| CE 37 | Ti | 3 | 0 | C | approx 5 | 1.9 | 3.6 |

In this connection, infiltration values up to U 2.5 mm and of the cross-cut grade up to Gt 2 can be regarded as sufficiently good.

While an optimum $H_2O_2$ content of approximately 40 to 70 g/l resulted for the crystallinity and resistance of the pre-phosphating layer, slightly better results for the lacquer paint adhesion emerged with 80 g/l, however. In all, the no-rinse examples in accordance with the invention proved to be of at least equal value to the conventional spray pre-phosphating method of CE 37.

In test series D, sheets of aluminium AA 5754 and of AA 6016 were pre-phosphated in the no-rinse method with the pre-phosphating solution 1, but without the addition of $H_2O_2$. In this connection, the layer weights were varied systematically and apart from this, in each case, one portion of the sheets was oiled. After this, deforming tests were carried out. In this connection, it emerged that the cold forming of the sheets which were pre-phosphated and not oiled still had a certain friction which corresponded to the friction which resulted when sheets which had been coated with a Zr-containing pickling system, used as a standard quality, and subsequently coated with oil, were deformed. Clearly better deforming results emerged, however, in the case of sheets which were pre-phosphated and oiled. Parallel to this, the strength of an adhesive connection was tested: the strength of the glued pre-phosphated sheets lay in a comparable order of magnitude to that of the pickled sheets.

The pre-phosphated or pickled sheets were then subsequently phosphated with the phosphating solution 4, but with 18.2 g/l $P_2O_5$, with 0.23 g/l free fluoride and with almost the same acid values as in Table 4, then rinsed with a rinsing solution based on zirconium fluoride and coated with a cathodic dipping lacquer paint. The pre-phosphated sheets displayed a corrosion and lacquer paint adhesion result that was no worse than that of the sheets which were pickled to start with, which represent a standard quality. Parallel to this, further sheets of this type were additionally provided with a filler and covering lacquer paint for a total automobile lacquer paint structure and tested parallel to this. In all cases, a coating was carried out in each case without oil and with oil, or with an acrylate-based dry lubricant commercially available for use on automobiles and specially optimised for this purpose and additionally with oil, before, in all cases, subsequent phosphating and lacquer painting was carried out—possibly after a heat treatment for 30 minutes at 205° C., as sometimes usual in the automobile field. All pre-phosphated variants displayed an equally good or, as an exception, an even slightly better result than the sheets which were pickled to start with (Table 8).

TABLE 8 test results for the pre-phosphated and subsequently phosphated and also lacquer painted sheets of series D made of aluminium alloys AA 6016, in comparison with sheets which were initially pickled and then phosphated and also lacquer painted.

| | Example/comparative example | | | | | | | |
|---|---|---|---|---|---|---|---|---|
| | CE44 | B44 | B45 | B46 | CE47 | B47 | B48 | B49 |
| subsequent phosphating solution or Zr-containing pickle | pickle | 1 | 1 | 1 | pickle | 1 | 1 | 1 |
| layer weight of the first coating in mg/m$^2$ | 2–8 as Zr | 1300 | 1300 | 1300 | 2–8 as Zr | 1300 | 1300 | 1300 |
| oil application | yes | yes | yes | no | yes | yes | yes | no |
| dry lubricant application | no | yes | no | no | no | yes | no | no |
| heat treatment 30 mins 205° C. | — | — | — | yes | — | — | — | yes |
| layer weight of the phosphating with solution 4 in g/m$^2$ | 3.6 | 3.3 | 3.3 | 3.3 | 3.6 | 3.3 | 3.3 | 3.3 |
| KTL lacquer paint | yes | yes | yes | yes | yes | yes | yes | yes |
| Filler and covering lacquer paint | — | — | — | — | yes | yes | yes | yes |
| Lockheed test according to DIN EN 3665: infiltration in mm | 1.8 | — | 1.8 | — | — | — | — | — |
| 1 year free weathering according to VDA 621–414: infiltration in mm | — | — | — | — | U 0 | U 0 | U 0 | U 0 |
| cross-cut grade according to DIN EN ISO 2409: at start | Gt 0 | Gt 0 | Gt 0 | Gt 0 | Gt 1 | Gt 1 | Gt 1 | Gt 0 |
| ditto: after 240 hours condensed moisture —constant climate test according to DIN 50017 KK | Gt 0 | Gt 0 | Gt 0 | Gt 0 | Gt 1 | Gt 1 | Gt 1 | Gt 1 |

The invention claimed is:

1. A method comprising applying a phosphate coating to a metallic coil by wetting a surface of the metallic coil with an aqueous, acidic phosphating solution and drying the phosphating solution on the coated surface of the coil to form a crystalline-coating on said metallic coil, wherein the phosphating solution comprises 26 to 60 g/l of zinc ions; at least 5 to 40 g/l of manganese ions; 50 to 300 g/l of phosphate ions, calculated as $P_2O_5$ and 25 to 120 g/l of peroxide calculated as $H_2O_2$, to form a coating having a coating weight in the range of from 0.2 to 5 g/m$^2$.

2. A method comprising applying a phosphate coating to a metallic coil by wetting a surface coil metallic with an aqueous, acidic phosphating solution and drying of the phosphating solution to form a crystalline coating on the surface of the coil, wherein the phosphating solution comprises 10 to 60 g/l of zinc ions; 0.5 to 40 g/l of manganese ions; 50 to 300 g/l of phosphate ions, calculated as $P_2O_5$; and 25 to 120 g/l of peroxide ions, calculated as $H_2O_2$ to form a coating having a coating weight of from 0.2 to 5 g/m$^2$.

3. A method according to claim 1, wherein the phosphating solution is free or substantially free of nickel or contains up to 20 g/l of nickel ions.

4. A method according to claim 1, wherein the phosphating solution contains polymers, copolymers and/or cross polymers, in particular of N-containing heterocyclic compounds, preferably of vinyl pyrrolidones.

5. A method according to claim 1, wherein a phosphating solution is used in which the ratio of the sum of cations to the phosphate ions, calculated as $P_2O_5$, ranges from 1:1 to 1:8.

6. A method according to claim 1, wherein an amount of phosphating solution in the range from 1 to 12 ml/m$^2$ is applied to the metal parts for drying.

7. A method according to claim 1, wherein a layer weight for the precipitated and dried phosphate layer in the range from 0.3 to 3 g/m$^2$ is formed with the phosphating solution.

8. A method according to claim 1, wherein the phosphating solution is applied by spraying by roller application, by flooding and sub sequent squeezing off, by splashing and subsequent squeezing off or by dipping and subsequent squeezing off.

9. A method according to claim 1, wherein a phosphate layer having the following composition is formed:

free or substantially free of nickel or up to a content of 10% by weight nickel;

5 to 40% by weight Zn, at least 5 to 14% by weight Mn, and 20 to 70% by weight phosphate, calculated as $P_2O_5$.

10. A method according to claim 1, wherein after drying the coated surface wetted with a second aqueous, acidic phosphating solution, this second solution being free or substantially free of nickel, or containing up to 20 g/l of nickel ions in the phosphating solution and 0 to 20 g/l of zinc ions, at least 5 g/l manganese ions, and 5 to 50 g/l of phosphate ions, calculated as $P_2O_5$.

11. A method according to claim 1, wherein belbre wetting with the first and/or second phoaphating solution, the metal parts are wetted with an activating solution or activating suspension.

12. A method according to claim 1, wherein the first phosphating solution contains at least 0.3 mg/l of copper ions, and the second phosphating solution which is optionally used contains 0.1 to 50 mg/l of copper ions.

13. A method according to claim 1, wherein at least one of the second phosphating solutions has an A-value, as ratio of the free acid to the total content of the phosphate ions, in the range from 0.03 to 0.6.

14. A method according to claim 1, wherein at least one of the second phosphating solutions contains at least one catalyst.

15. A method according to claim 1, wherein at lest one of the first or second phosphating solutions contains a peroxide admixture.

16. A method according to claim 1, wherein at least one of the first or second phosphating solution has a content of at least one compound based on perboric acid, lactic acid, tartaric acid, citric acid and a chemically related hydroxy carboxylic acid.

17. A method according to claim 1, wherein the first and/or second phosphating solution is applied at a temperature in the range from 10 to 80° C.

18. A method according to claim 1, wherein a passivating solution is applied directly to a phosphate layer.

19. A method according to claim 1, wherein the first and/or second phosphate layer which baa died on to the metal part is wetted with an oil, a dispersion or a suspension, in particular a deforming oil or anticorrosive oil and/or a lubricant.

20. A method according to claim 1, wherein an oil coating or lubricant coating which is possibly present is removed from or out of the first or second phosphate layer respectively.

21. A method according to claim 1, wherein the metal parts which have been provided with a first and/or second phosphate layer are coated with a lacquer paint, with another type of organic coating and/or with a layer of adhesive, and possibly deformed, in which case the metal parts which have been coated in this way can additionally be glued, welded, and/or connected in another way to other metal parts.

22. A method according to claim 1, wherein the metal surface was first provided with at least a tirat phosphate layer either before or not until after the deformation and/or assembly.

23. The method of claim 1, wherein the dried phosphate layer ranges from 0.3 to 2 g/m$^2$.

24. The method of claim 1, wherein the content of managanese ions ranges from 5 to 40 g/l.

25. A method according to claim 1, wherein the liquid film formed on the metal part with the phosphating solution is dried on the surface of the metal part at temperatures in the range from 20 to 120° C. with respect to PMT temperatures.

26. A method according to claim 25, wherein said catalyst is selected from the group consisting of a peroxide, a nitroguinidine, a nitrobenzene sulphonic acid, a hydroxylamine, a chlorate, a nitrate a perborate, and an organic nitro compound.

27. A method according to claim 26, wherein said catalyst is p-nitrotoluene sulphonic acid.

28. A method according to claim 1, wherein at least one of the first or second phosphating solution contains at least one ion selected from the group consisting of aluminum, boron, iron, hafnium, molybdenum, silicon, titanium, zirconium, fluoride, and complex fluoride, in free or bound form.

29. A method according to claim 28, wherein at least one of the first or second phosphating solution has a content of 0.01 to 5 g/l of fluoride in free or bound form.

30. A method comprising applying a phosphate coating to a metallic surface by wetting the surface with an aqueous, acidic phosphating solution and drying the phosphating solution on the coated surface to form a coating on said metallic surface, wherein the phosphating solution comprises 26 to 60 g/l of zinc ions; at least 5 to 40 g/l of manganese ions; 50 to 300 g/l of phosphate ions, calculated as $P_2O_5$, and 25 to 120 g/l of peroxide ions, calculated as $H_2O_2$.

31. A method comprising applying a phosphate coating to a metallic surface by wetting the metallic surface with an aqueous, acidic phosphating solution and drying of the phosphating solution to form a coating on the metallic surface, wherein the pbosphating solution comprises 10 to 60 g/l of zinc ions; at least 5 to 40 g/l of manganese ions; 50 to 300 g/l of phosphate ions, calculated as $P_2O_5$; and 25 to 120 g/l of peroxide ions, calculated as $H_2O_2$ to form a coating having a coating weight of from 0.2 to 5g/m$^2$.

32. The method of claim 31 wherein a layer having a layer weight for the precipitated and dried phosphate layer in the range from 0.3 to 3 g/m$^2$ is formed with the phosphating solution.

33. The method of claim 31, wherein the content of managanese ions ranges from 5 to 40 g/l.

34. A method comprising applying a phosphate coating to a metalic surface by wetting the surface with an aqueous, acidic phosphating solution and drying the phosphating solution on the coated surface to form a coating on said metallic surface, wherein the phosphating solution comprises 26 to 60 g/l of zinc ions; at least 5 to 40 g/l of manganese ions; 50 to 300 g/l of phosphate ions, calculated as $P_2O_5$, and 25 to 120 g/l of peroxide ions. calculated as $H_2O_2$, and contacting the resultant coated metallic surface with a second phosphating solution.

35. A method comprising applying a phosphate coating to a metallic surface by wetting the metallic surface with an aqueous, acidic phosphating solution and drying of the phosphating solution to form a coating on the metallic surface, wherein the phosphating solution comprises 10 to 60 g/l of zinc ions; at least 5 to 40 g/l of manganese ions; 50 to 300 g/l of phosphate ions, calculated as $P_2O_5$; and 25 to 120 g/l of peroxide ions, calculated as $H_2O_2$ and contacting the resultant coated metallic surface with a second phosphating solution, wherein a coating having a coating weight of from 0.2 to 5 g/m$^2$.

* * * * *